United States Patent [19]

Melland

[11] Patent Number: 4,620,405

[45] Date of Patent: Nov. 4, 1986

[54] STRUCTURAL MEMBER

[75] Inventor: Tristan G. Melland, Sandton, South Africa

[73] Assignee: David J. Stainer, Johannesburg, South Africa

[21] Appl. No.: 535,174

[22] Filed: Sep. 22, 1983

[30] Foreign Application Priority Data

Sep. 24, 1982 [ZA] South Africa ..... 82/7027

[51] Int. Cl.[4] ..... E04H 12/00

[52] U.S. Cl. ..... 52/645; 52/648

[58] Field of Search ..... 52/637, 638, 645, 646, 52/726, 108, 648; 182/178, 179; 403/217

[56] References Cited

U.S. PATENT DOCUMENTS

| | | | |
|---|---|---|---|
| 824,501 | 6/1906 | Molloy | 52/648 |
| 2,233,901 | 4/1941 | Scacchetti | 403/217 |
| 3,312,020 | 4/1967 | Schuster | 52/108 |
| 3,407,559 | 10/1968 | Durand | 52/637 |
| 3,656,269 | 4/1972 | Witschel et al. | 182/178 |
| 3,877,192 | 4/1975 | Metailler . | |
| 4,037,382 | 7/1977 | Jacobs | 52/638 |

FOREIGN PATENT DOCUMENTS

| | | | |
|---|---|---|---|
| 213713 | 6/1941 | Switzerland | 403/217 |
| 1213487 | 11/1970 | United Kingdom . | |

OTHER PUBLICATIONS

Search Report P2068/83.

*Primary Examiner*—James L. Ridgill, Jr.

*Attorney, Agent, or Firm*—Seidel, Gonda, Goldhammer & Abbott

[57] ABSTRACT

A modular unit 10 for constructing structural supports comprises an elongate member 12 and a link 14 extending laterally from the member. Castellations 28 are provided around a rim 26 at either end of the member so that the elongate members of similar units can be mated together. The link is made up of two struts 16 and 18 which are offset to one side of the elongate member and a flange 20 with bolt holes 22 is provided at the end of the link. Thus the links of two similar units can be bolted end to end to form a basic unit for use in constructing structural supports. Such a basic unit has two elongate members which are substantially parallel to each other and held apart and connected by the links. The invention also extends to an integral basic unit having such a configuration.

10 Claims, 8 Drawing Figures

STRUCTURAL MEMBER

FIELD OF THE INVENTION

The invention relates to a modular unit which can be combined with similar units to form structures.

BACKGROUND OF THE INVENTION

In many support structures such as light towers, tower cranes, beams, space frames, scaffolding, arches and stairways a problem arises in handling and constructing these structures before and during erection. This handling problem is as a result of the bulk and mass of the complete structure. It is an object of this invention to reduce such disadvantages and to reduce the need for skilled labour otherwise required for construction and erection.

SUMMARY OF THE INVENTION

According to the invention there is provided a modular unit for use in making up structural supports, each unit comprising an elongate member having mating end surfaces for mating with elongate members of like modular units and a link extending laterally from the elongate member with a connection means adjacent the end of the link which is remote from the elongate member, the connection means arranged to connect the link end to end with a link of a like modular unit such that the elongate members of the two modular units connected together by their links are at least substantially parallel.

This link member may include two struts which extent laterally from the elongate member and meet adjacent the connection means. One strut may extend laterally at right angles to the longitudinal axis of the elongate member.

The connection means may include a flange provided with holes so that it can be bolted to corresponding flange of a like modular unit. Preferably the link is offset to one side of a plane passing through the longitudinal axis of the elongate member.

The elongate member is preferably a tubular member provided with rims of increased external cross-section at each end, the rims having castellations at 15° intervals formed at the mating surfaces.

The elongate members may have internal longitudinal passages adapted to receive a tension rod which can hold mated units in a fixed position relatively to each other and/or through which electrical cables can pass.

This invention also extends to a structural unit comprising two elongate members having longitudinal axes at least substantially parallel to one another, the members having mating end surfaces for mating with elongate members of like structural members, the two members being held apart and joined together by a link. This structural unit may be formed by connecting two modular units together.

BRIEF DESCRIPTION OF THE DRAWINGS

Modular unis according to the invention will now be described by way of example with reference to the accompanying drawings in which.

DESCRIPTION OF A PREFERRED EMBODIMENT

Figure 1:
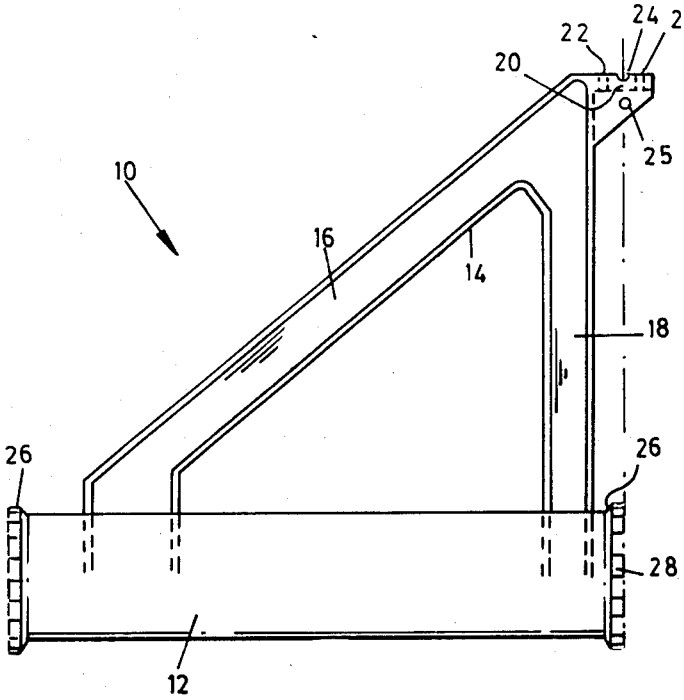
FIG. 1 is a plan view of the modular unit.
Figure 2:
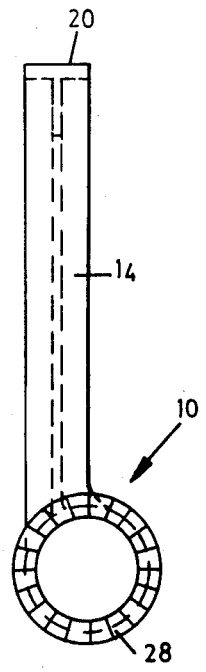
FIG. 2 is an end view of the modular unit of FIG. 1.

In FIGS. 1 and 2 a modular unit 10 comprises an elongate tubular member 12 and a triangular link 14, the link 14 extending laterally from the member 12. Two struts 16 and 18, which are fixed to the tubular member 12 and joined at a flange 20 remote from the tubular member 12, form the triangular link 14. The structs 16 and 18 have I-shaped cross-sections and their central plane lies to one side of a notional plane containing the diameter of the tubular member 12, as is clear in FIG. 1. It will also be seen in FIG. 2 that the plane containing the diameter of the tubular member also contains the side surfaces of the struts 16 and 18. The strut 18 extends at right angles from the member 12.

Bolt holes 22 are provided in the flange 20 and semicircular notch 24 is formed in the flange 20. The purpose of the holes 22 and the notch 24 will become apparent when the use of the unit 10 is described below. A hole 25 transverse to the bolt holes 22 is also provided. The end surface of the flange 20 may be provided with mating grooves or the like (not shown) so as to mate with like grooves on the flange 20 of another modular unit 10.

At either end of the tubular member 12 there is a zone of increased external cross-section which forms rims 26 at both ends. Castellations 28 are provided around these rims 26 so that two like members 12 can mate together. The castellations 28 are formed at 15° intervals and arranged so that the link 14 of two mated units 10 can be at 0° to each other or any other angle which is at an interval of 15°. Thus, in particular, the links 14 of two mated units can be placed at 90° or 120° to each other an once positioned together will not twist relative to one another.

Figure 3:
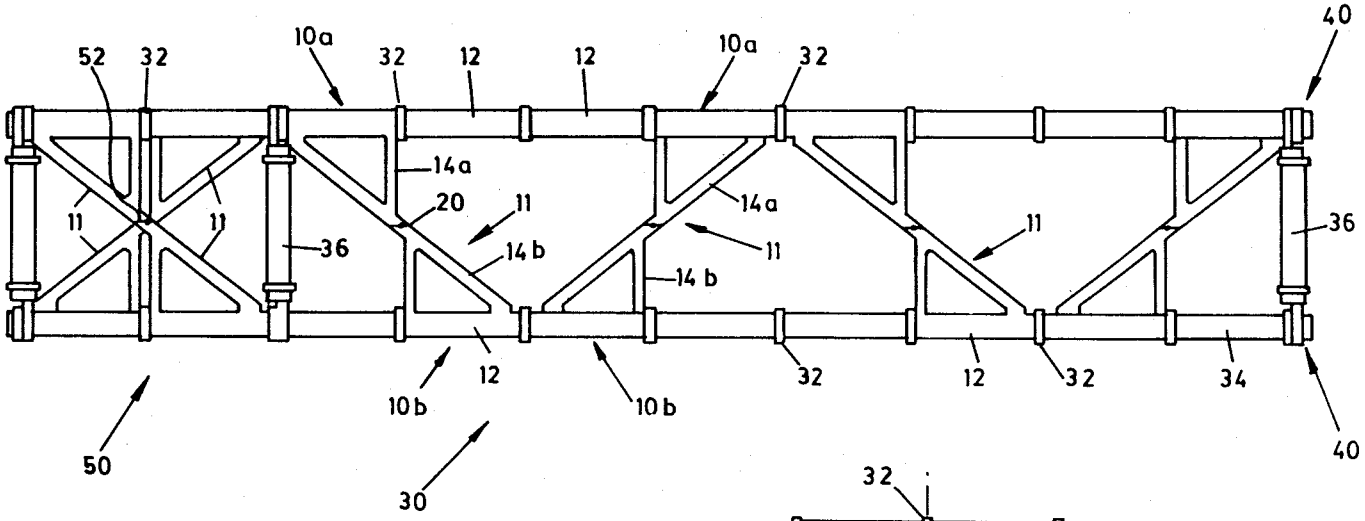
FIG. 3 is a side view of a beam assembled from basic units each comprising two modular units joined together.

The usefulness and versatility of the unit 10 is best illustrated with reference to FIGS. 3 and 4. FIG. 3 shows a square beam 30 made up of a number of modular units 10 as well as certain other components. A basic unit in the formation of the beam 30 is a basic unit 11 made up of two connected units **10*a* and 10*b*. (As will be explained with reference to FIGS. 7 to 9 such units may be provided as an intergral unit if preferred). The modular units 10*a* and 10*b* in FIG. 3 are bolted together by their flanges 20 to form each of the basic units 11. Thus a basic unit having two elongate members substantially parallel to each other is provided, the two members held apart and joined together by the connecting links 14*a* and 14*b***.

The part 50 of the beam is generally the same as the part 30 except that the elongate members of a basic unit are joined end to end with elongate members of another basic unit.

C-clamps 32 are provided around the rims at the joints formed by the mating elongate members so that the basic units are clamped together by the clamps 32 and bolted together at their flanges 20 to form a rigid, strong beam.

At the right-hand end of the beam in FIG. 3 a special elongate member 34 is used so that there is a flush end to the beam which may be rigidly secured by an end strut 36. In order to achieve this, special clamp 40 is used.

Figure 5:
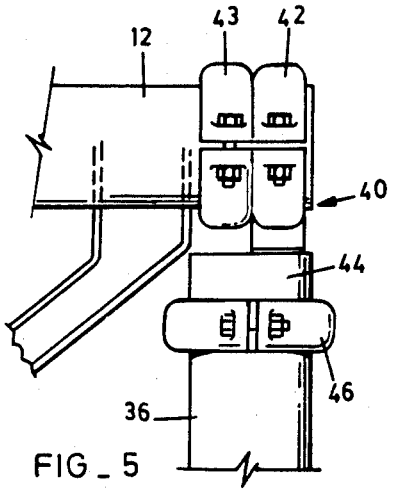
FIG. 5 is a side view of a clamp used at the end of a beam such as that illustrated in FIG. 3.

FIG. 5 shows an end to an elongate member 12, an end strut 36 and a special clamp 40. The clamp 40 comprises a C-clamp 42 which is fixed by screws (not shown) to a spigot 44 extending longitudinally from the strut 36 and held by a clamp 46. Rims (not shown) are provided at the end of the spigot 44 and at the end of the end strut 36 and these rims are provided with mating surfaces. A further spigot is held by another C-clamp 43 to the elongate member 12.

Figure 4:
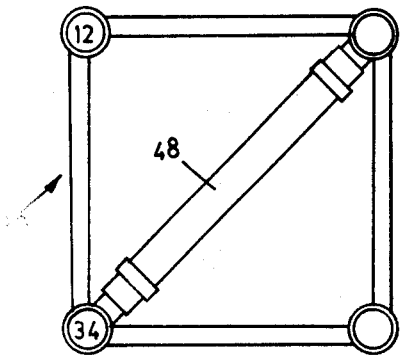
FIG. 4 is an end view of the beam of FIG. 3.

A similar arrangement is used to connect a diagonal strut 48 shown in FIG. 4. It can be seen that a braced square end to the beam is thus formed. However, it can also be seen that such a fabricated beam could easily be extended by joining it to a similar beam or by mating and bolting further basic units to the end of the beam.

It will be noted in FIG. 3, that the part 50 consists of double basic units. This double basic unit is made possible because the links 14 are offset as shown in FIG. 2. Thus two basic units 11 can be overlapped to form the double basic units.

It can be seen in the part 50 that the notches 24 (see FIG. 1) provided in the flanges 20 of the modular units 10 line up to form together the hole 52. Thus the double basic units can be further secured by bolting the units 10 together through the holes 52.

Figure 6:
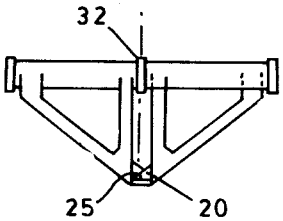
FIG. 6 is a side view of two modular units assembled together in an alternative manner.

In FIG. 6 another manner of connecting modular unit 10 is shown. A bolt (not shown) is provided which passes through the holes 25 of flanges 20. The bolt and a C-clamp 32 secure the modular units 10 together.

Numerous further applications of the modular units 10 and the basic units 11 formed from the modular units 10 are foreseen and some of these are mentioned below.

Beams with different cross-sections may be fabricated. For example, by placing the links 14 of mated units at 60° to each other a triangular beam may be formed. Also, some members 12 may be of shorter length than shown making it possible to add a shortened modular unit into a structure such as shown in FIG. 3. In addition, arched structures can be fabricated by using a particular unit 10 in combination with similar units but having a slightly shorter elongate member 12. It is then also necessary to slightly alter the shape of the castellations 28 so that mating of corresponding units can be effectively achieved.

In some applications it may be required to reduce the overall cross-sectional area of the beam. Such a reduction can be achieved by providing specially formed connecting units which can be arranged to connect together beams of different overall cross-section.

In some applications as required, a tensioned cable or rod can be provided which passes along the inside of the elongate members and is secured at the ends of a beam or like structure to rigidly hold the elongate members 12 together.

It might also be preferable in some applications to use C-clamps together with a tension cable or rod. Where a tension cable or rod is used tension cable guides may be provided within the elongate members 12.

The described links may be other than the struts 16 and 18 and could be a plate extending from the elongate member. Conversely, more than the two struts can be used to form the links. In general, the strength of each modular unit 10 can be changed to provide units of virtually any required strength according to the proposed application and preferred form of interconnection and arrangement of the units when making up a structural beam. Apart from choosing different materials for forming the modular units and the fact that the units can be joined securely together and to the other units, such as 12 at various relative angles, a very wide range of structural configurations are easily constructed to provide whatever strength is required.

Although structural beams have generally been described above the modular units 10 can conveniently be used to fabricate a mast or the like. In such an application elongate members 12 shown in FIG. 1 are mated one on top of the other to form a central pole. The links 14 then extend outwardly from this central pole and can be used as steps or as anchor points for the connection of items to the mast.

Figure 7:
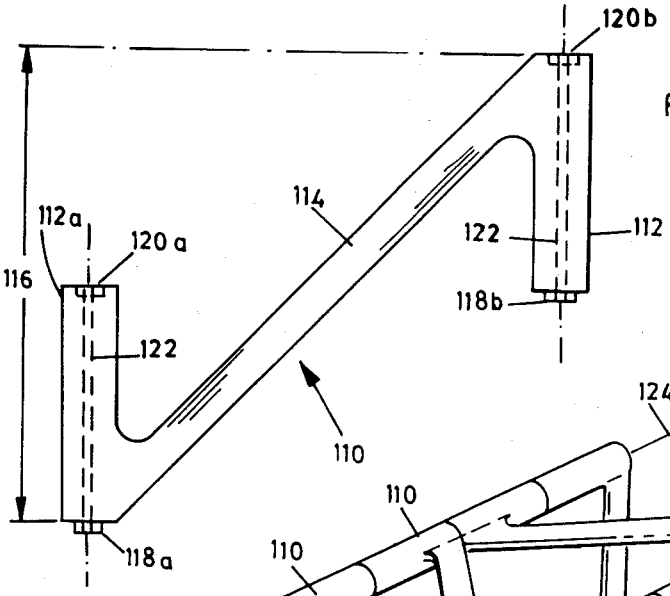
FIG. 7 is a side view of a different basic unit.

Referring to FIG. 7, a basic unit 110, which can be regarded as two modular units of FIG. 1 formed as an integral unit, comprises two elongate members **112*a* and 112*b*, which are parallel to each other and of equal length. The elongate members 112*a* and 112*b* are joined by a single link 114. The lengths of each of the members 112*a* and 112*b* are equal to half the overall length 16 of the modular unit. Each elongate member is provided with a respective lug 118*a* and 118*b* are corresponding sockets 120*a* and 120*b* and an axial bore 122 runs through the centre of the members 112*a* and 112*b***.

Figure 8:
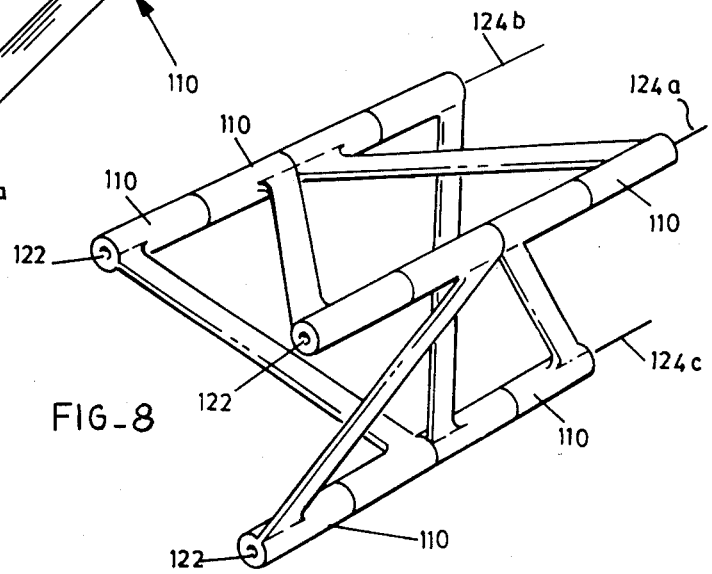
FIG. 8 is an isometric view of part of a structure formed of units of FIG. 7.

In FIG. 8, six of the modular units 10 of FIG. 7 are connected together to form a triangulated support structure. Cables **124*a*, 124*b* and 124*c* run through the axial bores 122** and these cables are tensioned and can be clamped at both ends so that a rigid structure is formed.

The modular units described may also be used to form square or polygonal support structures. Each unit alone is of such a mass that it is easy for a structure to be erected on site thus obviating the need for lifting machinery usually associated with erection and handling of such structures.

The described modular units may be manufactured from various materials such as metal (particularly aluminium) concrete or plastics. The units may be formed by moulding.

It will be appreciated that the modular units described with reference to FIGS. 1 to 6 are generally easier to fabricate or especially easier to form by moulding than the basic units described with reference to FIGS. 7 to 8. In fact, the units shown in FIGS. 1 to 6 required moulds of about half the size as compared to moulds required for forming the basic units shown in FIGS. 7 and 8, for example. Further, as one of the advantages of embodiments of the invention is easier erection of situ and transport to the point of erection, it is generally preferred to form modular units as shown in FIG. 1 rather than the unit shown in FIG. 7 where storage and transport considerations are significant. Nevertheless the transport, storage and especially ease of erection renders the basic unit shown in FIG. 7 considerably superior to presently known arrangements for forming or assembling structure members.

The units described are used for forming building structures and like support structures. However, the same advantages of easy erection, storage and versatility to create a wide variety are manifest as units in building small models or even for use as a child's toy or plaything. For example, the described units may be provided in a form suitable for a child to build a support structure in the same way as he may play with building blocks and/or enable the child or anyone else to build a model.

I claim:

1. A versatile modular unit for use in forming a structural beam, the unit comprising:

(a) an elongate, round tubular member having an identical first and second end;

(b) said tubular member including connection means at each end of the tubular member for matingly connecting each end of the tubular member in direct, face-to-face twist-free contact with the end of the tubular member of an identical modular unit positioned in end-to-end, coaxial relation with the first mentioned modular unit;

(c) a triangular link member which extends rigidly and traversely from the tubular member, the link being connected to the tubular member;

(d) a strut which forms at least a part of the triangular link member and which extends from the tubular member at an acute angle to the tubular member, the strut being connected to the tubular member;

(e) a flange being located at an end of the strut remote from the tubular member, the flange presenting a generally planar flange surface which is contained in a plane normal to a plane containing an end of the tubular member; and (f) the flange surface being adapted to contact the corresponding flange surface of an identical modular unit arranged with its tubular member parallel to, but spaced from, the tubular member of the first-mentioned modular unit, whereby the struts of the units are coaxial and form, in combination, a continuous diagonal brace between the spaced, parallel tubular members.

2. The modular unit of claim 1 wherein the generally planar flange surface has a series of grooves therein enabling positive face-to-face mating to take place between the flange surfaces of two modular units.

3. The modular unit of claim 1 wherein the connection means at the ends of the tubular member include annular lips protruding outwardly from the wall of the tubular member, the annular lip at an end of the tubular member lying alongside the corresponding annular lip of an identical modular unit when the units are positioned in coaxial, end-to-end relationship and wherein a clamp can be applied to the adjacent lips to clamp them one to the other and so hold the tubular members rigidly in face-to-face end-to-end relationship.

4. The modular unit of claim 3 wherein the connection means at the ends of the tubular member also include axially directed castellations, the castellations at an end of the tubular member being mateable with corresponding castellations at the end of the identical modular unit when the units are positioned in end-to-end coaxial relationship, the mating castellations preventing relative twisting between the tubular members when the annular lips are clamped together.

5. The modular unit of claim 1 wherein the triangular link member has a central plane which is offset from a plane containing a diameter of the tubular member, one surface of the triangular link member lying in a plane containing a diameter of the tubular member.

6. The modular unit of claim 5 wherein the triangular link member includes a further strut which extends rigidly from the tubular member at right angles to the tubular member and which meets the first-mentioned strut adjacent the flange.

7. The modular unit of claim 6 wherein the flange has at least one bolt hole extending through the flange at right angles to the axis of the tubular member, and wherein the unit includes a further bolt holes in the vicinity of the flange which extends at right angles to the bolt hole through the flange.

8. A modular unit for use in forming a structural beam, the unit comprising:

(a) first and second identical spaced, parallel, round tubular members;

(b) each of said tubular members including connection means at each of the tubular members for matingly connecting each tubular member with another tubular member arranged in end-to-end coaxial relationship therewith;

(c) a link extending rigidly from and being connected to one end of the first and second tubular members to the opposite end of the other of said first and second tubular member with the result that the modular unit has a generally Z-shaped shape with the tubular members being offset from one another in a longitudinal direction;

(d) the link being offset to one side of a plane containing a diameter of a tubular member; and (e) the length of each of the tubular members being equal to half of the overall length of the unit in the longitudinal direction.

9. A structural beam comprising:

(a) a plurality of modular units, each unit being joined to another unit in end-to-end fashion;

(b) each of said units including (i) an elongate, round tubular member having identical first and second ends;

(ii) said tubular member including connection means at each end of the tubular member for matingly connecting each end of the tubular member in direct, face-to-face, twist-free contact with the end of the tubular member of an identical modular unit positioned in end-to-end, coaxial relation with the first mentioned modular unit;

(iii) a triangular link member which extends rigidly are traversely from the tubular member, the link being connected to the tubular member;

(iv) a strut which forms at least a part of the triangular link member and which extends from the tubular member at an acute angle to the tubular member, the strut being connected to the tubular member;

(v) a flange being located at an end of the strut remote from the tubular member, the flange presenting a generally planar flange surface which is connected in a plane normal to a plane containing an end of the tubular member; and (vi) the flange surface being adapted to contact the corresponding flange surface of an identical modular unit arranged with its tubular member parallel to, but spaced from, the tubular member of the first-mentioned modular unit, whereby the struts of the units are coaxial and form, in combination, a continuous, diagonal brace between the spaced, parallel tubular members, so enabling the modular unit to form in combination with other modular units, a beam having a first chord composed of a series of tubular members arranged in coaxial relationship and at least one other chord spaced from and parallel to the first chord and composed of a further series of coaxial tubular members with the struts of the various units forming diagonal bracing spanning between the chords and connecting the chords rigidly to one another.

10. A structural beam comprising:

(a) a plurality of modular units, each unit being joined to another unit in an end-to-end fashion;

(b) each of said units including (i) first and second identical spaced, parallel, round tubular members;

(ii) each of said tubular members including connection means at each end of the tubular members for matingly connecting each tubular member with another tubular member arranged in end-to-end coaxial relationship therewith;

(iii) a link extending rigidly from and being connected to one end of one of the first and second tubular members to the opposite end of the other of said first and second tubular member with the result that the modular unit has a generally Z-shaped shape with the tubular members being offset from one another in a longitudinal direction;

(iv) the link being offset to one side of a plane containing a diameter of a tubular member; and (v) the length of each of the tubular members being equal to half of the overall length of the unit in the longitudinal direction.

* * * * *

UNITED STATES PATENT AND TRADEMARK OFFICE

CERTIFICATE OF CORRECTION

PATENT NO. : 4,620,405

DATED : November 4, 1986

INVENTOR(S) : Tristan G. Melland

It is certified that error appears in the above-identified patent and that said Letters Patent is hereby corrected as shown below:

On Page 1, Position 73, delete "David J. Stainer, Johannesburg, South Africa".

On Page 1, Position 73, insert "Fifty Percent Undivided Interest Assigned To David J. Stainer, Johannesburg, South Africa".

Signed and Sealed this

Seventh Day of April, 1987

*Attest:*

DONALD J. QUIGG

*Attesting Officer*

*Commissioner of Patents and Trademarks*